United States Patent [19]

Reick

[11] Patent Number: 4,525,286

[45] Date of Patent: Jun. 25, 1985

[54] ENHANCED GREASE

[75] Inventor: Franklin G. Reick, Westwood, N.J.

[73] Assignee: Michael Ebert, Mamaroneck, N.Y.

[21] Appl. No.: 586,820

[22] Filed: Mar. 6, 1984

[51] Int. Cl.[3] ..... C10M 5/18

[52] U.S. Cl. ..... 252/21; 252/16; 252/25; 252/40.5; 252/42; 252/37; 252/58

[58] Field of Search ..... 252/16, 21, 25, 58, 252/42, 40.5

[56] References Cited

U.S. PATENT DOCUMENTS

| | | | |
|---|---|---|---|
| 3,159,557 | 12/1964 | Ambrose | 204/59 QM |
| 4,127,491 | 11/1978 | Reick | 252/16 |
| 4,284,518 | 8/1981 | Reick | 252/16 |
| 4,349,444 | 9/1982 | Reick | 252/58 |

*Primary Examiner*—Jacqueline V. Howard

*Attorney, Agent, or Firm*—Michael Ebert

[57] ABSTRACT

An enhanced grease usable with high-speed bearings and in other applications involving severe operating conditions where standard greases normally give rise to overheating, excessive wear and failure of the parts being lubricated within a relatively short operating period. The enhanced grease has two major components—the first being a hybrid lubricant constituted by a stable suspension of sub-micronic PTFE particles in an oil carrier; the second component acting as a gelling agent for the first component and being in the form of a standard grease composed of a thickener dispersed in a lubricating oil. The ratio, by volume, of the two components is such that the resultant semi-solid gel has thixotropic properties and exceptional lubricating characteristics.

11 Claims, 1 Drawing Figure

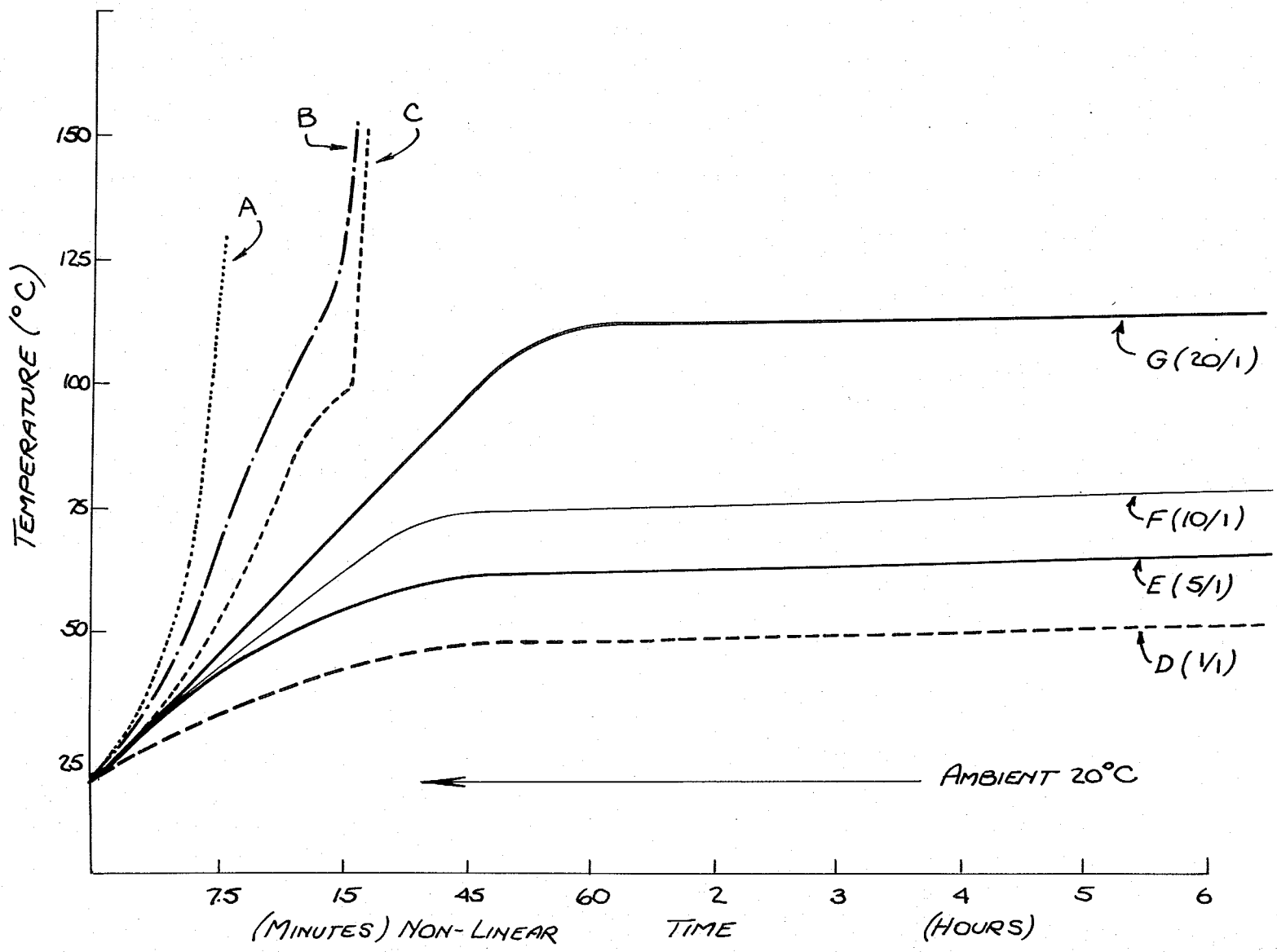
G (20/1)
F (10/1)
E (5/1)
D (1/1)
AMBIENT 20°C
C
B
A
150
125
100
75
50
25
TEMPERATURE (°C)
7.5
15
45
60
2
3
4
5
6
(MINUTES) NON-LINEAR TIME
(HOURS)

ENHANCED GREASE

BACKGROUND OF INVENTION

1. Field of Invention:

This invention relates generally to the field of lubricants, and more particularly to an enhanced grease having two major components—the first being a hybrid lubricant constituted by a stable suspension of sub-micronic PTFE particles in an oil carrier; the second component acting as a gelling agent for the first component and being in the form of a standard grease composed of a thickener dispersed in a lubricating oil.

The search for effective liquid and semi-solid lubricants probably got under way with the invention of the wheel and is today still in progress, for lubricants currently available fall well short of ideal. A milestone in this continuing search is the development in about 1400 B.C. by the ancient Egyptians of an axle grease for chariot wheels made up of animal fat and a calcium soap thickener. Another notable event in the history of lubrication is the use by the Chinese in 780 A.D. of a mixture of vegetable oil and calcined lead.

Even the most carefully finished metal surfaces have minute projections and depressions therein which introduce resistance when one surface shifts relative to another. The application of a fluid lubricant to these surfaces reduces friction by interposing a film of oil therebetween, this being known as hydrodynamic lubrication. In a bearing, for example, the rotation of the journal causes oil to be drawn between it and the bearing so that the two metal surfaces are then separated by a very thin oil film. The degree of bearing friction depends on the viscosity of the oil, the speed of rotation and the load on the journal.

Should the journal start its rotation after a period of rest, it may not drag enough oil to float the surfaces apart; hence friction would then be considerably greater, the friction being independent of the viscosity of the lubricant and being related only to the load and to the "oiliness" property of the residual lubricant to stick tightly to the metal surfaces. This condition is referred to as "boundary lubrication," for then the moving parts are separated by a film of only molecular thickness. This may cause serious damage to overheated bearing surfaces.

The two most significant characteristics of a hydrodynamic lubricant are its viscosity and its viscosity index, the latter being the relationship between viscosity and temperature. The higher the index, the less viscosity will change with temperature. Fluid lubricants act not only to reduce friction, but also to remove heat developed within the machinery and as a protection against corrosion.

Though fluid film separation of rubbing surfaces is the most desirable objective of lubrication, it is often unobtainable in practice. Thus bearings built for full fluid lubrication during most of their operating phases actually experience solid-to-solid contact when starting and stopping. In some instances, the use of a solid lubricant alone or in combination with a liquid lubricant is indicated.

Typical solid lubricants are soft metals such as lead, the layer lattice crystals such as graphite and molybdenum disulphide, as well as the crystalline polymers such as Teflon (polytetrafluoroethylene or PTFE).

Under severe operating conditions, hydrodynamic or fluid lubrication is inadequate to minimize friction and wear; for fluid film separation of the rubbing surfaces is not possible throughout all phases of operation. Hence, the better lubricant for an engine or other mechanism having moving parts is one which combines hydrodynamic with solid lubrication. In this way, when adequate separation exists between the rubbing surfaces, a protective fluid film is interposed therebetween; and when the surfaces are in physical contact with each other, friction therebetween is minimized by layers of solid lubricant bonded to the surfaces.

In theory, one can best approach this ideal by interposing the rubbing parts of engines with solid lubricant layers which are integrally bonded thereto, concurrent use being made of a lubricating oil which functions not only to provide hydrodynamic lubrication but also to cool the rubbing parts. In addition, the oil may carry synthetic organic chemicals to perform other functions to counteract wear and prevent corrosion.

The practical difficulty with attaining this ideal is that the parts coated with solid lubricants, such as a PTFE layer, are very expensive and therefore add considerably to the overall cost of the engine. Moreover, in PTFE-coated parts which operate under rigorous conditions, the solid lubricant layers bonded thereto have a relatively short working life, so that it is not long before the only lubricant which remains effective in the engine is the fluid lubricant.

In order to provide a lubricating action which is both solid and fluid, my prior U.S. Pat. No. 3,933,656 discloses a modified oil lubricant which is suitable for applications which call for effective lubrication throughout all phases of operation. This modified lubricant is constituted by major amounts of a conventional lubricating oil intermingled with minor amounts of polytetrafluoroethylene particles in the sub-micronic range in combination with neutralizing agents which stabilize the dispersion to prevent agglomeration and coagulation of the particles.

The present invention is concerned exclusively with greases for use in those applications in which a liquid lubricant is inappropriate. Originally, greases were thick crude oils or semi-solid fats. In the modern age, greases are now specially prepared solid or semi-solid dispersions of organic or inorganic thickeners in lubricating oils to which silicones and other ingredients are added in minor amounts to impart special properties to the grease.

A grease rather than a liquid lubricant is used where high bearing pressures are encountered, or where oil drip from bearings is interdicted. Grease is also necessary where the motion of the contacting surfaces is discontinuous, making it difficult to maintain a separating film therebetween. Grease is generally employed where the parts to be lubricated are difficult to get at, or where a danger exists that a dripping liquid lubricant will contaminate the product being produced by the lubricated machine. An acceptable lubricating grease will flow into bearings by the application of pressure, and it will remain in contact with the moving surfaces and not leak out under centrifugal action or by reason of gravity flow.

Thickeners for grease include soap and non-soap types. Soap thickeners are constituted by compounds having cations of Al, Ba, Na, Pb, Li or Sr, these being formed in situ by reacting a metal base with fatty acids. Those non-soap inorganic thickeners which enjoy the widest application include colloidal thickeners or modified clays such as bentonites, which are rendered organophilic and water repellent. A description of metallic soaps usable as thickeners is contained in the Witco Metallic Stearates handbook published by Witco Chemical—Organics Division (1970).

The value of a lubricating grease over a broad temperature range depends both on its apparent viscosity at low temperatures and its resistance to deterioration at elevated temperatures. The apparent viscosity is a function of the pour point and viscosity index of the fluid employed in the grease. The pour point of an oil is the lowest temperature at which an oil will flow when maintained under quiescent conditions. Lack of stability at high temperatures can arise from collapse of the structure or deterioration of one or more of the grease ingredients. Thus a grease which fails to adequately reduce friction will cause the lubricated bearing surfaces to overheat; and this, in turn, will cause the breakdown of the grease and destruction of the bearings.

When circulating oils act to lubricate cams, tappets, timing gears and piston rings, or when the parts to be lubricated operate under boundary conditions, anti-wear additives are necessary. Use is often made for this purpose of zinc dithiophosphate which also acts as a corrosion inhibitor. It is the chemical characteristic of this substance which affords wear resistance. Anti-wear agents function through a chemical polishing action which can take place at relatively low temperatures. However, anti-wear additives do not increase the lubricity of the oil, and in fact may introduce friction.

In high speed machinery in which the bearings are lubricated by conventional greases having anti-wear additives, the greases do not usually reduce friction to a degree preventing excessive heating of the bearings. Consequently, as the grease proceeds to deteriorate at elevated operating temperatures, the metal parts become scored and failure is experienced after a relatively short period.

2. Prior Art

U.S. Pat. No. 3,159,557 to Ambrose entitled "Grease Containing Polytetrafluoroethylene" discloses a grease having PTFE particles dispersed therein to create an extreme high pressure lubricant. In compounding this grease, a thickening soap is first prepared, the soap then being admixed with mineral or synthetic oil to form a grease, after which the PTFE particles are added to the grease composition.

The problem with a grease of the Ambrose type is that when it is put to use in bearings and in other moving parts, and the grease is then rendered fluid to effect hydrodynamic lubrication, the PTFE particles dispersed in the fluid will tend to agglomerate. As noted in my prior U.S. Pat. No. 4,127,491, under high shear and impact, these agglomerates will consolidate into a tough, gummy mass that interferes with lubrication and has deleterious results. The fact that PTFE particles, when added to a lubricant, because of their inherent instability tend to agglomerate, is also noted in the Browning U.S. Pat. No. 3,194,762.

The present invention makes use, as one component thereof, of a stable hybrid lubricant of the type disclosed in my above-identified prior patents in which a colloidal dispersion of PTFE particles in an oil carrier are stabilized to prevent agglomeration of the particles, use being made for this purpose of a neutralizing agent that acts to maintain the particles in suspension regardless of the prevailing working conditions.

SUMMARY OF INVENTION

In view of the foregoing, the main object of this invention is to provide an enhanced grease which has thixotropic properties and exceptional lubricating characteristics markedly superior to standard greases whereby the enhanced grease acts as effective lubricant for high-speed bearings and in other applications involving severe operating conditions under which standard greases are ineffective.

More particularly, an object of this invention is to provide an enhanced grease constituted by a hybrid lubricant in which sub-micronic PTFE particles are stably suspended in a fluid lubricant carrier, the hybrid lubricant being converted into a gel by means of a standard grease which is intermingled with the hybrid lubricant.

Also an object of the invention is to provide an enhanced lubricant which is relatively easy to compound.

Briefly stated, these objects are attained in an enhanced grease usable with high-speed bearings and in other applications involving severe operating conditions where standard greases normally give rise to overheating, excessive wear and failure of the parts being lubricated within a relatively short operating period. The enhanced grease has two major components—the first being a hybrid lubricant constituted by a stable suspension of sub-micronic PTFE particles in an oil carrier; the second component acting as a gelling agent for the first component and being in the form of a standard grease composed of a thickener dispersed in a lubricating oil. The ratio, by volume, of the two components is such that the resultant semi-solid gel has thixotropic properties and exceptional lubricating characteristics.

OUTLINE OF DRAWING

For a better understanding of the invention, reference is made to the attached drawing whose single figure takes the form of a graph comparing several formulations of an enhanced grease in accordance with the invention with several standard greases in terms of their lubricating characteristics when subjected to a 4-ball test in which the rising temperature of the balls as a result of friction is plotted along a time scale for each of the samples tested.

DESCRIPTION OF INVENTION

An enhanced lubricant in accordance with the invention has two major components, the first being a hybrid lubricant of the type disclosed in my prior U.S. Pat. Nos. 3,933,656; 4,127,491; 4,224,173; 4,349,444, the entire disclosures of which are incorporated herein by reference.

This hybrid lubricant is composed of PTFE solid lubricant particles in the colloidal or sub-micronic range which are suspended in a fluid oil carrier, which in practice may be a natural or synthetic lubricating oil or a combination thereof, to which is added a neutralizing agent to prevent agglomeration of the particles. The present invention uses as its first major component any one of the hybrid lubricants disclosed in my above-identified prior patents.

The second major component is any commercially available standard grease of good quality, such as greases marketed by Texaco, Inc. and identified in their Lubricating Oil and Grease Digest—Petroleum Products Department—USA (1979).

The term "standard grease" encompasses any of the greases described in the Standard Handbook of Lubricating Engineering by O'Connor and Boyd—McGraw Hill Book Co.—sponsored by the American Society of Lubricating Engineers.

In order to produce an enhanced grease in accordance with the invention, use is made of the hybrid lubricant in its concentrated form; that is, an additive before it is diluted with a crankcase oil or any other fluid lubricant already in the machine intended to be modified by this additive. This concentrated hybrid lubricant is gelled by means of a standard grease. To this end, appropriate amounts of the hybrid lubricant concentrate and of the standard grease are thoroughly intermingled by a colloid mill or by mixing apparatus performing a similar function, until a gel of acceptable consistency is obtained, which gel has thixotropic properties.

By a "hybrid lubricant concentrate," as distinguished from a dilute hybrid lubricant, is meant a concentrate having about one pound of PTFE solid sub-micronic particles dispersed in about one hundred lbs. of oil carrier such as Quaker State 10W-40 SAE. As seen under an electron microscope, this provices a rich colloidal suspension of PTFE particles. The term "concentrate" is not limited to this ratio, for it includes ratios from about one third to greater than one pound of PTFE relative to 100 lbs of oil.

We have found that the most effective ratio of hybrid lubricant concentrate to standard grease is about one-to-one by volume, for a relatively greater amount of hybrid lubricant will not produce a semi-solid gel product, but a product which is excessively fluidic in nature, whereas a lesser amount will produce an enhanced lubricant whose lubricating characteristics are not as good as one having a one-to-one ratio.

In order to make side-by-side comparisons between the lubricating characteristics of standard greases and those of enhanced greases in accordance with the invention, use is made of the four ball method. This is described in the 1981 ANNUAL BOOK OF ASTM STANDARDS, published by the American Society for Testing and Materials (Part 24—Petroleum Products and Lubricants [II]).

In a four-ball testing machine, the test balls are all fabricated of chrome alloy steel, three of the balls being clamped in fixed contact with each other in a cradle, as in an equilateral triangle. The fourth ball is held in a rotating chuck which touches each of the three stationary balls, these being coated with the lubricant being tested. In order to measure changes in temperature resulting from friction encountered in a test operation, the cradle is provided with a cavity into which is inserted a thermistor. The resistance of the thermistor is proportional to the prevailing temperature, the resultant electric current through the thermistor being indicated by a meter calibrated in centrigrade terms.

Tests on the 4-ball machine were run at a predetermined load and for specified periods of time, this resulting in the marking of the stationary balls with wear scars and score lines whose appearance is indicative of the load bearing capacity of the test lubricant. Thus the four-ball machine was used to determine the wear-preventing properties of the various greases under the test conditions applied thereto.

In the tests represented by the curves in the figure, the standard greases used were the well known "Lubrimatic" greases made by Petroleum Chemical Corporation of Omaha, Nebraska, these greases being tested in their normal state. The enhanced two-component greases in accordance with the invention which were tested, included as their grease component, a clear, wheel-bearing "Lubrimatic" grease.

These tests were run at a pressure of 80 kilograms, with the rotor ball rotating at a speed of 1700 RPM, all four balls having a diameter of $\frac{3}{8}$ inch. Test data was obtained by measuring the rise in temperature resulting from the frictional engagement between the rotor ball and the stationary balls lubricated with the grease under test. The temperature was measured on a temperature scale running from 0° to 150° C. plotted against time in a scale of 0 to 6 hours.

It is to be noted that the time scale shown in the figure is non-linear, for the first 60 minutes in this scale, which runs from 0 to 6 hours, takes up almost half the scale. The reason for this non-linearity is in order to magnify the rise of temperature which takes place in the initial period of operation, beginning with a starting temperature which is at ambient (about 20° C.).

Curve A represents the four-ball test conducted on a standard clear wheel-bearing grease (Lubrimatic). It will be seen in this curve that the temperature during the first five minutes of operation rose rapidly to well over 125° C. After this test, the rotor ball and stator balls were examined under a scanning electron microscope. It was evident from the deep scars on these balls that they had experienced a significant degree of wear and metal distress, and that had this grease been used on high-speed bearings, failure would have resulted after a relatively short operating period.

Curve B represents the four-ball test on a standard grease containing white lithium soap. It will be seen that this grease resulted in somewhat slower heating of the balls than in the first test; but after 15 minutes the temperature rose to well over 125° C. Subsequent examination under the electron microscope showed deep scars on the balls, very similar to those experienced with test A.

Curve C represents the four-ball test on a standard grease containing dark gray molybdenum disulfide. The temperature over the first 15 minutes rose gradually to 100° C., and then shot up rapidly to over 125° C. The resultant wear pattern on the balls, as seen under the electronic microscope, was even worse than that produced in the previous tests A and B.

Curve D represents the four-ball test run on one formulation of an enhanced grease in accordance with the invention. It will be seen, in this instance, that the temperature rose to about 50° C. in the first hour, and then stabilized at this level for the remainder of the six-hour test period.

As seen under the scanning electronic microscope, the balls which were used to produce curve D appeared to be highly polished, with only slight scar marks. Thus a dramatic improvement in lubricating characteristics is effected by the enhanced grease.

The enhanced grease, whose test is represented by curve D, had a ratio by volume of hybrid lubricant to standard grease of one-to-one. In order to determine the effectiveness of an enhanced grease with smaller relative amounts of the hybrid lubricant, three samples were prepared: one, represented by curve E, having a ratio of five parts of standard grease to one part of hybrid lubricant; the second (F), ten parts of grease to one part of hybrid lubricant; and the third and weakest (G), twenty parts of grease to one part of hybrid lubricant.

It will be seen in curve E (5/1) that the temperature for the enhanced lubricant stabilizes at about 60° C. for the full six-hour period; that for F (10/1), at about 75° C., and for G (20/1) at about 110° C.

Thus, as the ratio of grease to hybrid lubricant approaches a one-to-one ratio, the lubricating characteristics improve significantly, though at the same time the product becomes less grease-like or semi-solid because of the higher percentage of fluid. Beyond the one-to-one ratio, the relative amount of fluid is excessive, and the lubricant ceases to behave as a gel. However, it is still highly useful, for it then becomes a non-Newtonian fluid having dilatancy properties causing the fluid to cling to the rotating spindle rather than being hurled centrifugally away from the bearing region.

It is to be understood that in formulating an acceptable enhanced lubricant with a given standard grease that the most effective ratio of hybrid lubricant concentrate to the standard grease must take into account two variables—the first being the amount of standard grease relative to that of the hybrid lubricant necessary to effect gelling of the hybrid lubricant to produce a semi-solid enhanced grease. This amount is readily determined by simple physical tests to determine whether the resultant gel is thixotropic and will not drip.

The second variable is the amount of hybrid lubricant relative to standard grease which provides an acceptable degree of enhancement, and this is best determined by a four-ball or equivalent test in which the degree of enhancement is reflected by the rise in temperature resulting from the use of the enhanced grease.

Obviously, if under relatively heavy load conditions, the rise in temperature stabilizes at a level no higher than 50 to 75° C. and remains at that level for several hours, the enhancement characteristics are acceptable. And if the temperature stabilizes at about twice the ambient temperature level (20° C.) despite the relatively heavy load, the grease enhancement characteristics are then at an optimum value, for then the lubiicant acts to markedly reduce friction between the lubricated surfaces and very little wear will be encountered.

One could achieve gelling of the hybrid lubricant by using thickening agents and additives of the type now in use with standard greases, omitting the liquid oils included in such greases. But in economic and practical terms, it makes far better sense to exploit prepared standard greases which are mass-produced and sold at modest prices, rather than undertake the elaborate preparation of suitable thickening agents only for the purpose of gelling the hybrid lubricant.

While there has been shown and described a preferred embodiment of enhanced grease in accordance with the invention, it will be appreciated that many changes and modifications may be made therein without, however, departing from the essential spirit thereof.

Further Tests

As pointed out in the prior art section, it is known to intermix PTFE particles with grease, as evidenced by the above-identified Ambrose patent. In order to test a typical commercially available grease using the same four-ball method previously described, tests were conducted on "SLICK 50" Grease containing PTFE particles. This grease is marketed by Petro-Lon Canada, Limited of Toronto, Ontario.

In this test on the PTFE grease, it was found that after 15 minutes of operation, the temperature rose to over 55° C.; and that after thirty minutes, the temperature ran well over 100° C. Examination under the electron microscope revealed deep scoring of the balls, this indicating that this product was not acceptable for high speed bearings and other applications involving severe operating conditions.

It must again be stressed that in a grease in accordance with the invention, the sub-micronic PTFE particles are maintained in a stable suspension in the oil carrier forming the hybrid lubricant component and do not agglomerate in the course of operation. We have found that with greases to which PTFE particles have been added, not only does agglomeration occur, but that because the particles in commercial greases are relatively coarse, they are ploughed ahead of the working interface and make no useful contribution to lubrication.

In the tests on the enhanced grease previously reported, the tests were run for six hours, as shown in the curves. In order to find the end or failure point, these same six-hour tests were repeated on a day to day basis for seven days, with the temperature still rising to no higher than about 50° C., so that even after a week, no failure point was approached.

One final point: Many lubricants and greases are expressly made to function effectively under high temperature conditions. To a degree, this is self-contradictory; for the reason high temperatures are encountered is that the lubricant applied to the working surface is inefficient for its intended purpose and fails to sufficiently reduce friction, as a consequence of which excessive heat is generated. In other words, the typical high pressure lubricant is designed to operate under the very conditions for which the lubricant itself is responsible. With an enhanced grease in accordance with the invention, significant savings in energy are made possible, for the work heretofore expended in creating heat in the machine is now available for more productive results with a lesser expenditure of energy.

I claim:

1. An enhanced grease usable with high-speed bearings and in other applications involving severe operating conditions where standard greases give rise to overheating and excessive wear, said enhanced grease comprising:

A. a first major component constituted by a hybrid lubricant concentrate formed by a stabilized suspension of sub-micronic polytetrafluoroethylene solid particles in a lubricating oil carrier;

B. a second major component intermingled with the first component and constituted by a standard grease composed of a thickening agent dispersed in a lubricating oil, said first and second components being in a ratio which results in gelling of the first component to produce a semi-solid gel having thixotropic properties and lubricating characteristics measurably superior to that of the standard grease.

2. An enhanced grease as set forth in claim 1, wherein said hybrid lubricant includes a neutralizing agent to stabilize the suspension and prevent agglomeration of the particles.

3. An enhanced lubricant as set forth in claim 1, wherein said hybrid lubricant concentrate is constituted by polytetrafluoroethylene particles and an oil carrier in a ratio of about $\frac{1}{3}$ to one pound of PTFE to about 100 pounds of carrier.

4. An enhanced lubricant as set forth in claim 1, wherein said thickening agent in said standard grease is constituted by a soap formed by a metal compound.

5. An enhanced lubricant as set forth in claim 1, wherein said standard grease includes a corrosion inhibitor.

6. An enhanced lubricant as set forth in claim 1, wherein said standard grease includes an anti-oxidant.

7. An enhanced lubricant as set forth in claim 1, wherein the ratio of hybrid lubricant concentrate to standard grease by volume is at least one to five.

8. An enhanced lubricant as set forth in claim 1, wherein the ratio of hybrid lubricant concentrate to standard grease is about one to one.

9. An enhanced lubricant as set forth in claim 1, wherein said oil carrier in said hybrid lubricant includes a synthetic lubricating oil.

10. The method of compounding an enhanced grease usable with high-speed bearings and in other applications involving severe operating conditions under which standard greases give rise to overheating and excessive wear;

A. producing a first major component constituted by a hybrid lubricant concentrate formed by a stabilized suspension of sub-micronic polytetrafluoroethylene solid particles dispersed in a lubricating oil carrier; and B. intermingling said first component with a second major component constituted by a standard grease composed of a thickening agent dispersed on a lubricating oil, said first and second components being in a ratio which results in a gel having thixotropic properties and lubricating characteristics measurably superior to those of the standard grease.

11. The method set forth in claim 10, wherein said ratio by volume is about one-to-one.

* * * * *